US005907133A

United States Patent [19]

Agostinelli

[11] Patent Number: 5,907,133

[45] Date of Patent: May 25, 1999

[54] DEVICE FOR ELECTROACOOSTIC DIFFUSION, WITH DIAPHRAGMS, SPIDERS AND HORNS OF BALSA WOOD OR MIXTURES THEREOF

[76] Inventor: Paolo Agostinelli, Santa Croce 2257/A, 30135 Venezia, Italy

[21] Appl. No.: 08/952,523

[22] PCT Filed: Jun. 10, 1996

[86] PCT No.: PCT/IT96/00117

§ 371 Date: Nov. 21, 1997

§ 102(e) Date: Nov. 21, 1997

[87] PCT Pub. No.: WO97/37513

PCT Pub. Date: Oct. 9, 1997

[30] Foreign Application Priority Data

Apr. 2, 1996 [IT] Italy ..... RM96A0208

[51] Int. Cl.[6] ..... G10K 11/00

[52] U.S. Cl. ..... 181/173; 181/167; 181/152

[58] Field of Search ..... 181/152, 155, 181/157, 159, 167, 169, 170, 171, 172, 173; 381/193, 202, 204, 205, 156, 160

[56] References Cited

U.S. PATENT DOCUMENTS

| | | | |
|---|---|---|---|
| 2,615,995 | 10/1952 | Voigt | 181/152 |
| 2,638,510 | 5/1953 | Brami | 181/152 |
| 2,852,089 | 9/1958 | Cohen et al. | 181/159 |
| 5,668,886 | 9/1997 | Sakamoto et al. | 381/202 |

*Primary Examiner*—Khanh Dang

*Attorney, Agent, or Firm*—Smith, Gambrell & Russell, LLP; Beveridge, DeGrandi, Weilacher & Young Intellectual Property Group

[57] ABSTRACT

A device for electroacoustic diffusion includes a basket; a balance supported by the basket, made of balsa wood or formed with a balsa wood stripe fixed at its ends with a coil glued at its middle; a balsa wood membrane supported by the basket; a suspension adjacent to the membrane and supported by the basket; and an electroacoustic structure adjacent the basket and opposite the balance. The electroacoustic structure includes a first plate adjacent the basket, a second plate, a magnet between the first plate and the second plate, and a coil between the first plate and the second plate. The membrane can take on various shapes, including: (a) a truncated-cone shape, including triangular pieces of balsa wood, steam folded, glued, and placed with fibers of the balsa wood in a radial orientation, (b) a dome-shape, and (c) a planar shape.

10 Claims, 3 Drawing Sheets

DEVICE FOR ELECTROACOOSTIC DIFFUSION, WITH DIAPHRAGMS, SPIDERS AND HORNS OF BALSA WOOD OR MIXTURES THEREOF

BACKGROUND OF THE INVENTION

The present invention concerns a device for electroacoustic diffusion comprising diaphragms, balances, and trumpets, made out of balsa wood or mixtures including balsa wood.

It is well known that electroacoustic diffusers, also called loudspeakers, transform electric signals into acoustic energy by means of the vibration of a diaphragm, which usually has a conic shape, a dome-shape, or a planar shape.

The material used for constructing the membrane is fundamental for obtaining the desired electroacoustic features. Research for obtaining the best response from the point of view of the electroacoustic effects, the psychoacoustic effects, and the tone-color of the sound, has led to the use of materials that have various determined features like lightness and non-deformability.

The lightness property allows one to obtain correct reproduction of the high frequencies, while the non-deformability property determines the ability of the material to be exposed to considerable acoustic pressures without distortions due to deformations of the material.

It is easy enough to find materials with the above mentioned features; the use of materials derived from aerospace technologies has allowed one to obtain optimal electroacoustic features, but these materials confer a particular tone-color which often makes the sounds sound reproduced and far removed from a natural tone-color.

One of the reasons that has led to the use of cellulose—which is at present the most widely used material—is that its tone-color is the most natural if compared with other materials that are more rigid and heavy.

Also mixtures of metal and synthetic materials have been used, and this was always with the purpose of obtaining lightness, non-deformability, and correct tone-color.

The main problem remains one of obtaining a non "colored" sound, i.e., the most natural possible sound and, where it may be accepted, a pleasant coloring.

For getting as near as possible to a natural reproduction of the sound, membranes have been developed out of fir-wood, which, even if they are very rigid, have a correct tone-color. These membranes, however, have the problem of being heavy, which prevents one from obtaining acceptable speeds at those frequencies that are not low.

Diffusers have been produced with vibrating wood stripes of different lengths, so as to have different masses according to the frequency to be reproduced, but the dynamic, i.e., the capacity of obtaining quick variations of acoustic pressure, is rather reduced due to the physical structure of the diffuser, because the stripes always have considerable inertia due to their total weight.

SUMMARY OF THE INVENTION

It is the aim of the present invention to provide, in addition to balances and trumpets, a membrane that may supply good electroacoustic response with minimal coloring and pleasant listening, without any trace of the artfulness that characterizes diffusers that make use of the materials known in the art.

The aim set forth is reached by means of the device according to the present invention, a device for electroacoustic diffusion, which mainly comprises:

a diaphragm consisting of pieces of balsa wood, having a thickness from 0.5 to 5 mm, cut in such a way that the structure of the fibers prevents deformation, and therefore, in the case of a truncated-cone shape, which is typical for a loudspeaker, includes radial fibers, with triangular pieces folded with steam and glued;

a diffuser for high, medium, and low frequencies, and sub-woofers, produced out of balsa wood with thicknesses that vary according to the frequency;

a balance that makes the movement of the coil coaxial to the air-gap of the magnet and thus prevents the coil from touching the fixed part of the magnetic circuit, wherein the balance is put into vibration together with the membrane, so as to act with the vibration of the membrane that is mechanically coupled to the same due to its elasticity and itself working as a sound source, even if at a lower rate, so as to interfere with the emission of the membrane with products of intermodulation, wherein the balance is produced out of balsa wood or consists of a stripe of balsa wood fixed at the ends with the coil and glued at the middle, wherein the elasticity of the wood stripe allows movement of the coil without lateral movements, and therefore without interference with the fixed part of the loudspeaker; and a trumpet produced from balsa wood that is cut, steam-folded, and glued, so as to obtain a sound with a natural tone-color, different from the one usually obtained with plastic or metal materials or with other woods, as the trumpet vibrates and the vibrations are transmitted from the balsa wood, which, due to its natural macromolecular structure and to its lightness, does not alter the sound, and on the contrary, it has a particular natural coloring; furthermore, due to its lightness, the balsa wood also can transmit high frequency vibrations, unlike other materials used that somehow form a filter that cuts the higher frequencies.

In possible variants of the device according to the present invention, a diaphragm may be obtained by steam-folding a balsa bar suitably cut so as to have one single gluing, with its fibers put into tension by the folding and which, even if they are not radial, offer a perfect rigidity.

The loudspeaker thus realized offers a complete and satisfactory electroacoustic response with a natural and pleasant tone-color. In fact, the lightness of the membrane allows the reproduction of high frequencies, while the complex, but natural and not artificially obtained molecular structure of the wood transmits the vibrations with a tone-color similar to the one of musical instruments.

The diffuser according to a possible variant may be provided with a plane membrane with a great surface, like the planar diffusers that are typically produced, that vibrates due to coils glued to the membrane, obtaining a very good tone-color even if with a reduced dynamic with respect to the one obtained with the use of the loudspeakers with a conical membrane, but this is typical for planar diffusers which, due to their construction, do not allow vibrations of the membrane of a considerable width.

The advantages of the device according to the present invention are many and considerable:

the described elements, due to the molecular structure of the balsa wood and to its lightness, give the loudspeaker a clean, natural, and pleasant tone-color;

the density of the balsa wood, like that of any kind of wood, is not even and uniform, and therefore, it allows one to obtain slightly different tone-colors, like musical instruments, and this is not a prejudicial element, but it allows one to obtain diffusers different from one another with large possibilities for obtaining more brilliant or warmer tone-colors;

the porosity of the balsa wood depends on the tree, and therefore, the quality of the wood is a further variable;

according to the different qualities of balsa wood, a change in the tone-color may be obtained, to thereby always provide the desired results;

in a way similar to the way for conventionally working wood, balsa wood also may be impregnated with oils or resins or painted; and the effects of the wood quality and of the treatments of the same are similar to those that may be obtained in musical instruments, and this expands the possibility of obtaining diffusers different from one another, but always with the desired electroacoustic effect.

BRIEF DESCRIPTION OF THE DRAWINGS

The present invention will be described in more detail hereinbelow, in conjunction with the enclosed drawings, in which two embodiments are shown. The enclosed drawings include.

DETAILED DESCRIPTION OF THE INVENTION

Figure 1:
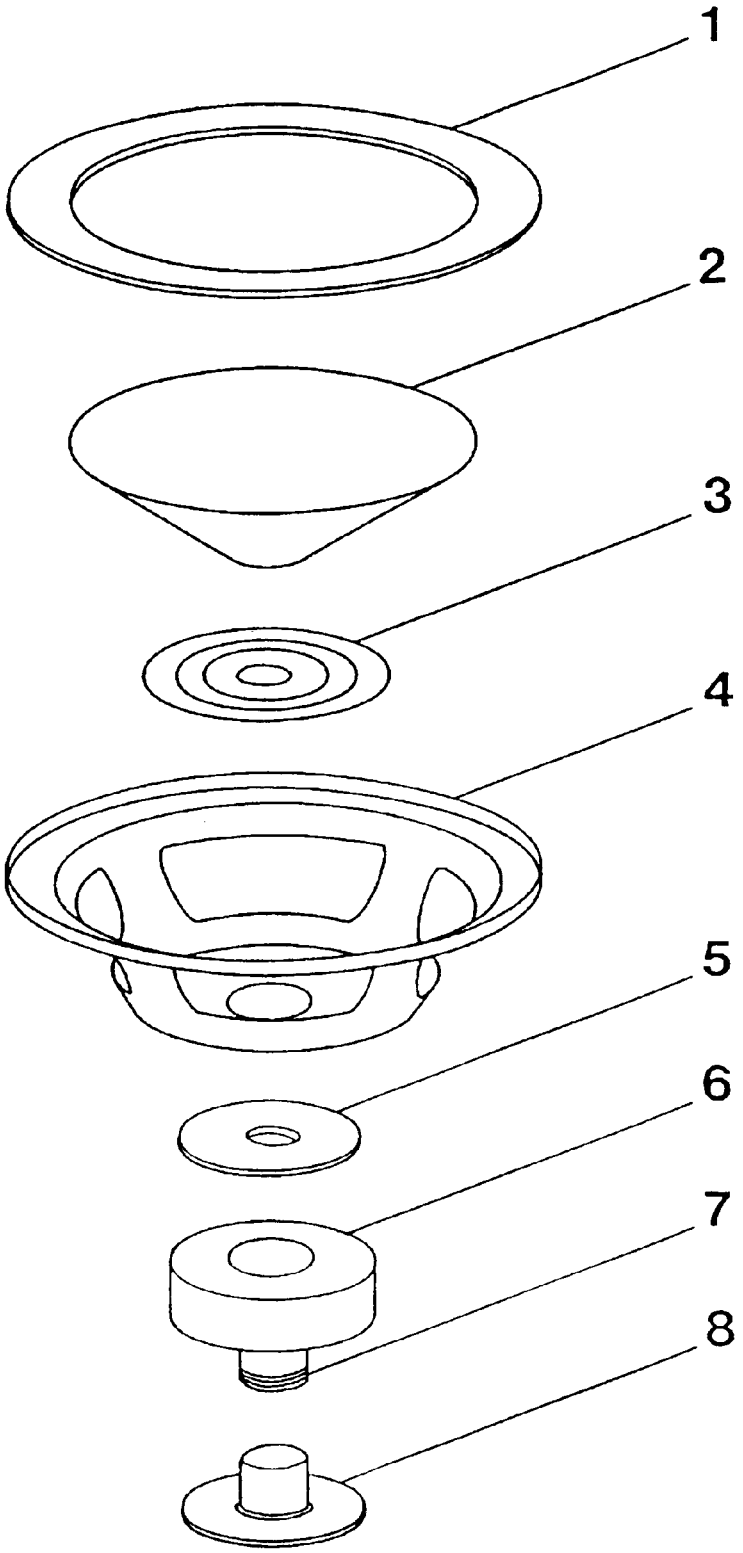
FIG. 1, which shows an exploded axonometric view of a device for electroacoustic diffusion with a cone-shaped membrane, according to the present invention.

The enclosed figures show a device for electroacoustic diffusion, with balancing diaphragms and trumpets made out of balsa wood or mixtures including balsa wood. These devices include:

a suspension 1, a truncated-cone shaped membrane 2, consisting of triangular pieces of balsa wood, steam folded, glued, and placed with the fibers in a radial position, a balance 3, produced out of balsa wood or formed with a balsa wood stripe fixed at its ends with the coil glued at the middle, wherein the elasticity of the wood stripe allows for movement of the coil without lateral movements, and therefore without interference with the fixed part of the loudspeaker;

a basket 4 for supporting the elements of the loudspeaker;

an electroacoustic structure comprising an upper plate 5, a magnet 6, a coil 7, and a lower plate 8; and a coupling trumpet 11 or 12, cut out of balsa wood, steam folded, and glued, for transmitting—due to its lightness—high frequency vibrations.

Figure 2:
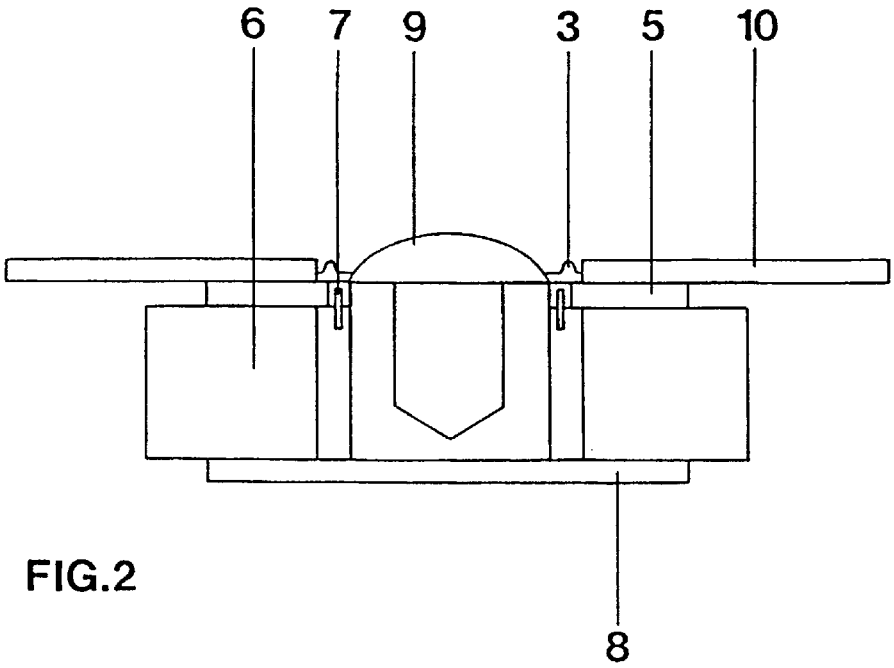
FIG. 2, which shows a lateral schematic view of a variant of the device according to the present invention including a dome-shaped membrane.
Figure 3:
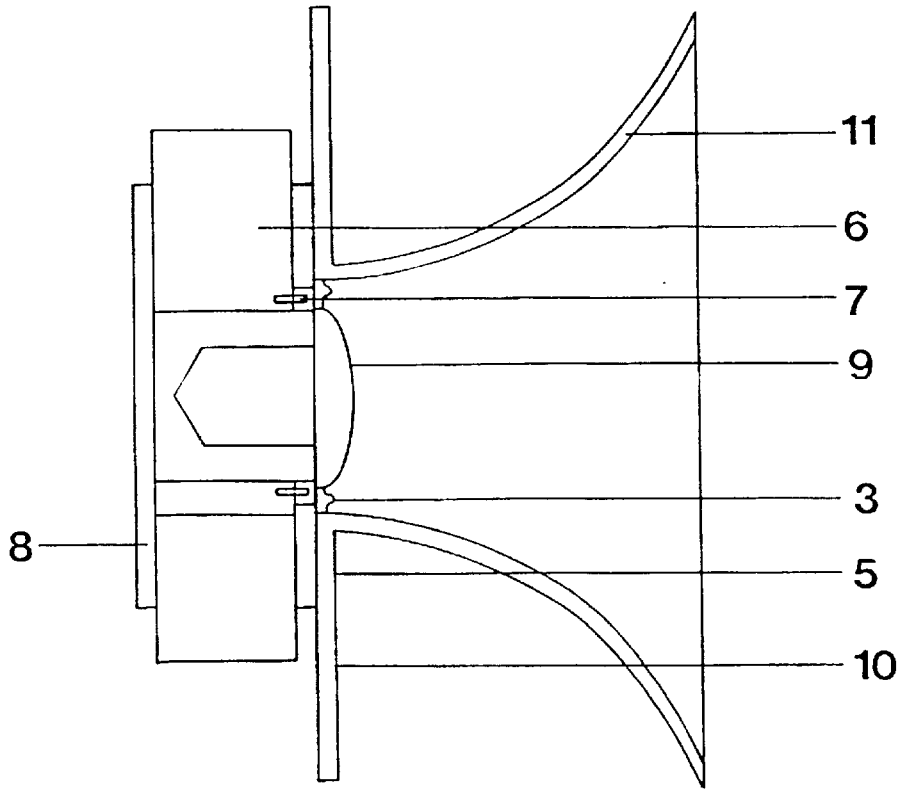
FIGS. 3 and 4, each of which shows a lateral schematic view of a diffuser, one shaped as a trumpet (FIG. 3) and one as a folded trumpet (FIG. 4), and each made out of balsa wood.
Figure 4:
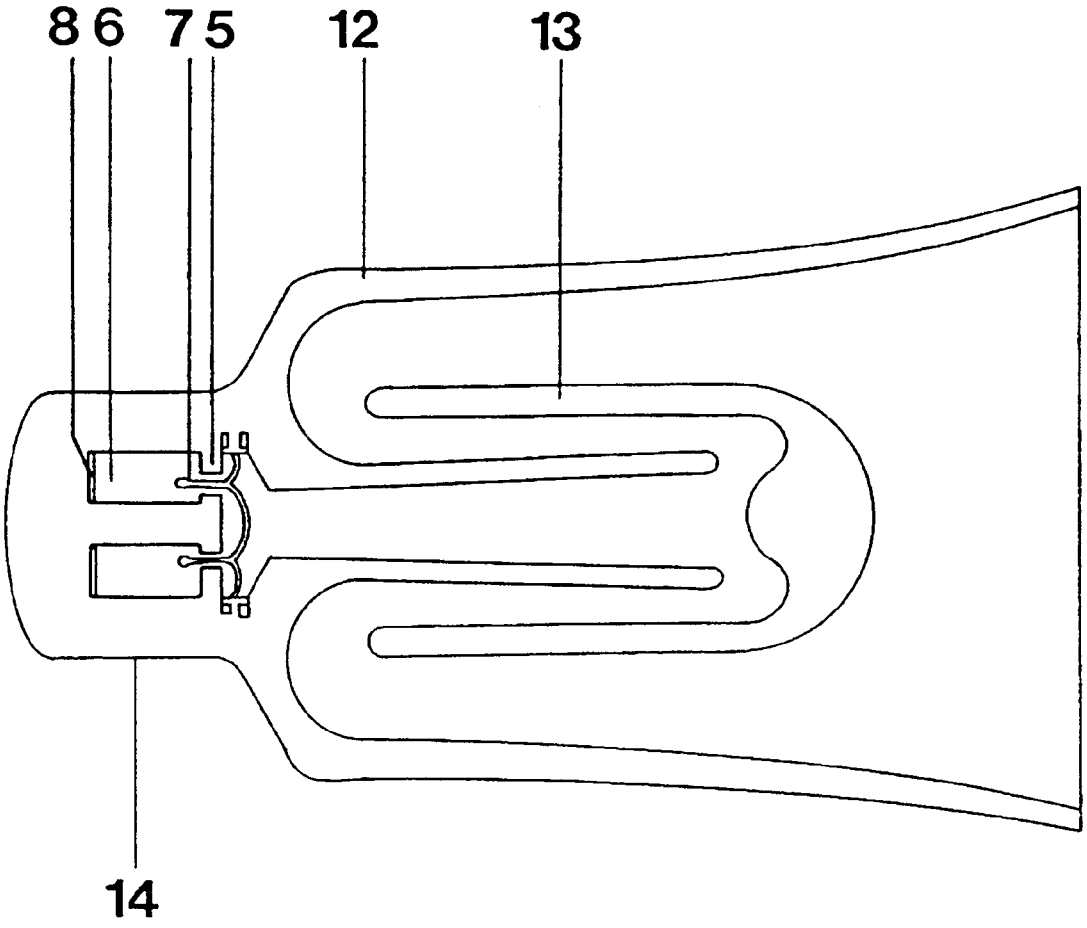

In the variant of FIG. 2, a dome-shaped membrane 9 is shown—produced out of balsa wood—and a fixing flange 10. In FIGS. 3 and 4 the following additional details are shown:

a trumpet 11;

a folded trumpet 12;

a reflector 13; and a bottom 14.

According to the present invention, similar results concerning the electroacoustic, tone-color, and dynamic response can be obtained making use of mixtures of balsa wood with fibers cut in thin stripes and glued into the desired shape, as well as by grinding the balsa wood and mixing it up with different kinds of binder, so as to obtain a dough to be shaped as desired. The further drying or cooking allows one to obtain membranes lighter than the usual cellulose dough, with the macromolecular structure typical for the balsa wood and with the results described above for application in acoustic diffusers.

I claim:

1. A device for electroacoustic diffusion, comprising:

a basket;

a balance supported by the basket, wherein the balance is made of balsa wood or formed with a balsa wood stripe fixed at its ends with a coil glued at its middle;

a membrane supported by the basket, wherein the membrane is made of balsa wood and is provided in a shape selected from the group consisting of: (a) a truncated-cone shaped membrane, including triangular pieces of balsa wood, steam folded, glued, and placed with fibers of the balsa wood in a radial orientation, (b) a dome-shaped membrane, and (c) a planar membrane; and an electroacoustic structure adjacent the basket and opposite the balance, wherein the electroacoustic structure includes a first plate adjacent the basket, a second plate, a magnet between the first plate and the second plate, and a coil between the first plate and the second plate.

2. A device according to claim 1, wherein the membrane is the dome-shaped membrane.

3. A device according to claim 1, wherein the membrane is the truncated-cone shaped membrane obtained by steam folding a bar of balsa wood suitably cut so as to have one single gluing, with its fibers put into tension by the folding.

4. A device according to claim 1, wherein the membrane is a planar membrane, wherein a great surface of the planar membrane is arranged to vibrate due to coils glued to the membrane.

5. A device according to claim 1, wherein the balance is made with elements obtained from mixtures containing balsa wood, wherein the mixtures containing balsa wood include: (a) balsa wood fibers cut into thin stripes and glued, or (b) ground balsa wood mixed with binders so as to provide a dough that can be shaped and then dried.

6. A device according to claim 5, wherein the balance is made of thin stripes of balsa wood, wherein the elasticity of the balsa wood stripes allows for movement of the coil without lateral movement of the balance.

7. A device according to claim 1, further including a coupling trumpet, made of balsa wood.

8. A device according to claim 7, wherein the coupling trumpet transmits high frequency vibrations.

9. A device according to claim 8, wherein the balsa wood coupling trumpet is produced by steam folding and gluing a balsa wood starting material.

10. A device according to claim 1, further including a suspension member adjacent to the membrane and supported by the basket.

* * * * *